5/24/83 XR 4,385,294

United States Patent [19]

Miles

[11] 4,385,294

[45] * May 24, 1983

[54] RMS VOLTAGE CONTROL WITH VARIABLE DUTY CYCLE FOR MATCHING DIFFERENT LIQUID CRYSTAL DISPLAY MATERIALS

[75] Inventor: Larry L. Miles, Dallas, Tex.

[73] Assignee: Texas Instruments Incorporated, Dallas, Tex.

[ * ] Notice: The portion of the term of this patent subsequent to Mar. 17, 1998, has been disclaimed.

[21] Appl. No.: 156,701

[22] Filed: Jun. 5, 1980

Related U.S. Application Data

[62] Division of Ser. No. 948,933, Oct. 5, 1978.

[51] Int. Cl.[3] ..... G09G 3/36

[52] U.S. Cl. ..... 340/805; 340/784; 340/713; 350/332

[58] Field of Search ..... 340/784, 805, 713; 350/331, 332

[56] References Cited

U.S. PATENT DOCUMENTS

| | | | |
|---|---|---|---|
| 4,100,540 | 7/1978 | Fujita et al. | 340/805 |
| 4,121,203 | 10/1978 | Edwards et al. | 340/805 |
| 4,122,661 | 10/1978 | Tsuji | 340/805 |
| 4,127,848 | 11/1978 | Shanks | 340/805 |
| 4,257,045 | 3/1981 | Miles | 340/784 |

*Primary Examiner*—Marshall M. Curtis

*Attorney, Agent, or Firm*—Robert D. Marshall, Jr.; Leo N. Heiting; Melvin Sharp

[57] ABSTRACT

A method and system for driving a liquid crystal display (LCD) with adjustable drive voltages to match selected ones of a number of different liquid crystal materials utilize variable duty cycle control. Instead of regulating the battery supply voltage to provide desired driving voltage, the driving voltage is disabled for preselected portions of each cycle thereby controlling the root mean square voltage across the LCD segments during both the display-on and display-off states of each display segment to match the liquid crystal material. Two-, three- and four-way multiplexing or any other level of multiplexing may be used in conjunction with this method and system.

5 Claims, 5 Drawing Figures

RMS VOLTAGE CONTROL WITH VARIABLE DUTY CYCLE FOR MATCHING DIFFERENT LIQUID CRYSTAL DISPLAY MATERIALS

This is a division of application Ser. No. 948,933, filed Oct. 5, 1978.

BACKGROUND OF THE INVENTION

This invention relates to liquid crystal displays and more particularly to methods and systems for controlling the voltages driving liquid crystal displays.

Present-day electronic systems, such as calculators, timepieces, and the like, having multiplexed liquid crystal displays, require a regulated voltage Vp and fractional voltages for driving the segments and backplanes of the liquid crystal display. In prior art multiplexed liquid crystal display systems, voltage driving the display is controlled by means of a device such as a voltage regulator to match the driving voltage with the particular material used in the display. A center tap, for example, between a series of diodes and resistors provides the fractional voltage needed to drive the display. Controlling voltage by means of a regulator and center tap is difficult and results in unwanted consumption of power.

It is therefore an object of the present invention to provide an improved system and method of controlling liquid crystal display drive voltages.

It is another object of the present invention to provide means for lowering the root mean square voltage driving a liquid crystal display to match the particular display material without using a voltage regulator.

It is yet another object of the present invention to provide an improved means for varying the root mean square voltage driving a liquid crystal display with reduced power consumption.

It is a further object of the present invention to provide a means for controlling the root means square voltage driving a liquid crystal display that is suitable for use with a silver oxide battery and doubler system with low power CMOS circuitry.

BRIEF DESCRIPTION OF THE INVENTION

These and other objects are accomplished in accordance with the present invention by providing a means for varying the duty cycle of the voltage driving a liquid crystal display. Liquid crystal displays respond to the root mean square voltage across the display segments. By disabling the drive voltage so that both the segments and backplanes are coupled to the same potential for a predetermined length of time during each cycle of the drive voltage, the root mean square voltage is variable to match the particular display material during both the display on and display off states of each segment.

This method of matching the particular display material by varying the duty cycle may be used with two-, three- or four-way multiplexing, or any other level of multiplexing.

DETAILED DESCRIPTION OF INVENTION

Figure 1:
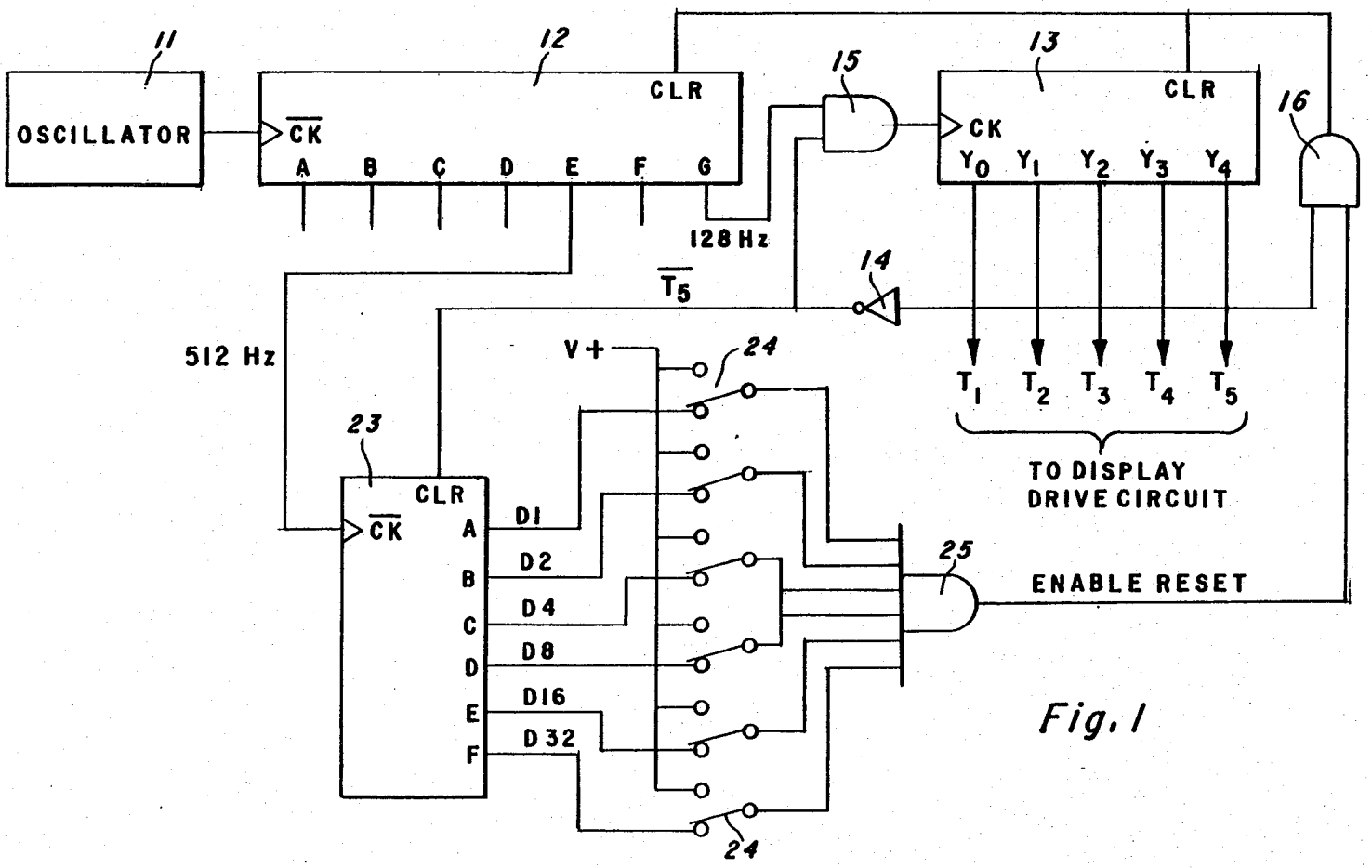
FIG. 1 is a circuit diagram embodying the present invention.

FIG. 1 shows a circuit for controlling the display drive circuit of a liquid crystal display. Countdown chain 12, driven by oscillator 11, generates 128 Hz and 512 Hz clocking signals for the operation of counters 13 and 23, respectively. Counter 13 counts four cycles of the incoming 128 Hz clocking signal and generates a distinct sequence of enabling signals during each cycle. During the first cycle, enabling signal T1 is a logic "1" and enabling signals T2–T4 are logic "0". During the second cycle enabling signal T2 is a "1" and enabling signals T1, T3 and T4 are "0". After the fourth cycle, a disabling signal T5 is a "1" and enabling signals T1–T4 are "0" for a selected period of time as determined by the setting of counter 23. Signals T1–T5 are transmitted to the display drive circuitry (FIG. 2*a*).

When signal T5 is "0", the output of inverter 14 is "1", which enables AND gate 15, thereby allowing 128 Hz clocking signals to go to counter 13. The output of inverter 14 also transmits a continuous clear signal to counter 23. When signal T5 is "1", the output of inverter 14 is "0", thereby disabling the 128 Hz clocking signals and enabling counter 23.

When enabled, counter 23 counts the number of cycles of the 512 Hz clocking signals corresponding to the "off" period during which the voltage driving the display segments is disabled. The closed or open position of each switch in switch group 24 determines the number of cycles counter 23 will count before enabling a reset signal from AND gate 25. When a switch is closed it corresponds to a binary "1" code; when open, it corresponds to a binary "0". All the switches are shown in closed positions in FIG. 1. This corresponds to the binary code 111111, i.e. 63 cycles, which must be counted before AND gate 25 is enabled. In this situation, the voltage driving the segments of the display is disabled for 63 cycles of the 512 Hz clocking signal. If it is desired to disable the driving voltage for only 31 cycles, for example, the switch connecting the D32 binary output of counter 23 is set to an open position. A logic "1" signal would then be continuously transmitted to AND gate 25 in lieu of D32 output signal and a reset signal would be triggered by AND gate 25 when all its other inputs are "1", i.e. when 31 cycles have been counted. The reset signal goes to AND gate 16 which clears counter 13 and disabling signal T5 becomes "0" and disables the clear signal to counter 13. When signal T5 is "0", inverter 14 generates a "1" signal which clears counter 23 and enables the 128 Hz clocking signals. Counter 13 begins its counting cycle again, generating signals T1–T5 in sequence as described above.

Figure 2A:
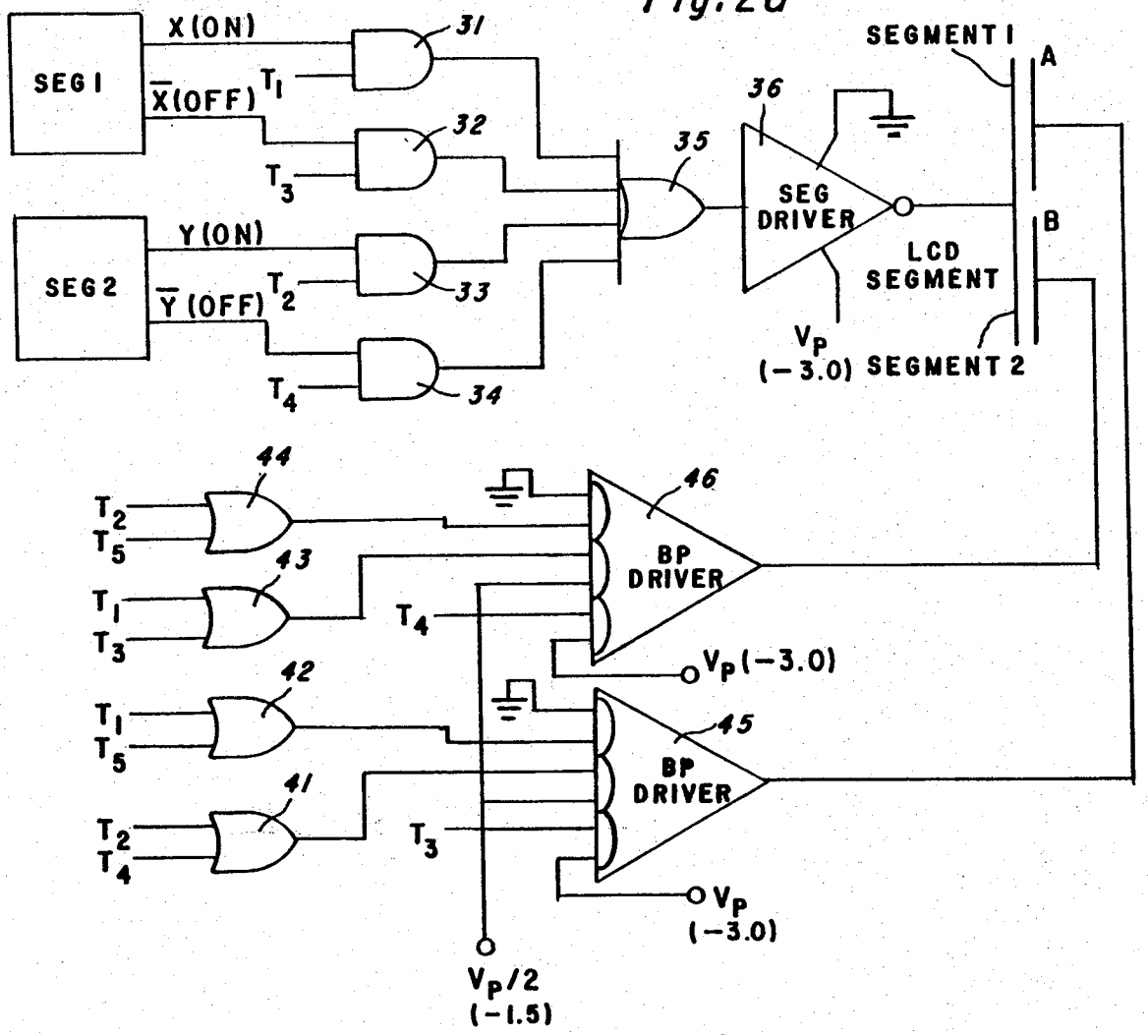
FIG. 2*a* is a circuit diagram of a two-way multiplexed liquid crystal display drive circuitry and drivers controlling the voltage driving the segments.
Figure 2B:
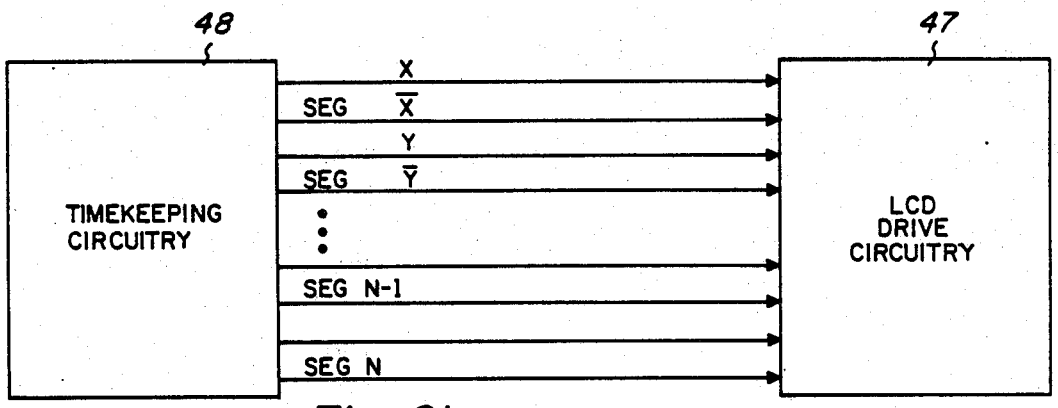
FIG. 2*b* is a block diagram of a timekeeping circuit inputting segment logic signals to a LCD drive circuit.

FIG. 2*a* shows a two-way multiplexed liquid crystal display and drive circuitry with two segments 1, 2 and two backplanes A, B. Segment logic signals X, $\overline{X}$, Y and $\overline{Y}$, corresponding to the on and off states of each segment, function as inputs along with enabling signals T1–T4 to AND gates 31–34. Segment logic signals X, $\overline{X}$, Y, $\overline{Y}$ are data inputs to a LCD drive circuit 47 from a system such as a timekeeping circuit 48 of an electric timepiece as shown in FIG. 2*b*. If segment 1 is on, logic signal X will be "1" or high and $\overline{X}$ will be "0" or low. If segment 1 is off, logic signal X is low and $\overline{X}$ is high.

Figure 3:
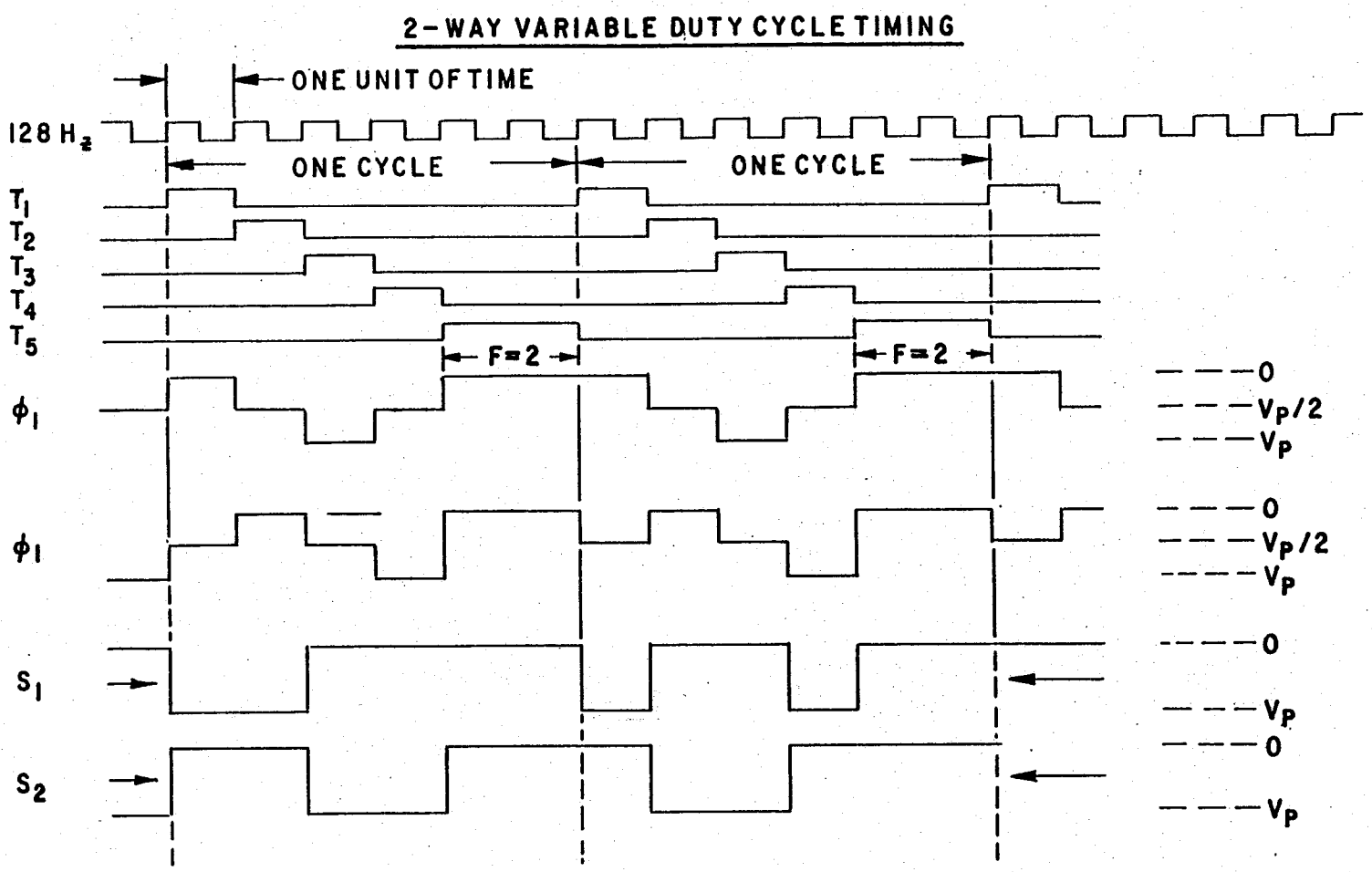
FIG. 3 is an illustration of two-way multiplexed variable duty cycle timing and voltage signals applied to the backplanes and segments of a liquid crystal display.

The arrangement is identical for segment 2. For example, if both segments 1 and 2 are on, the output of OR gate 35 is high during periods when enabling signal T1 or T2 is high and low during periods when enabling signal T3 or T4 is high. Driver 36 generates segment signal S1 as shown in FIG. 3. If both segments 1 and 2 are off the output of OR gate 35 is "1" during periods when enabling signal T3 or T4 is "1" and "0" when enabling signals T1 or T2 is "1". Driver 36 generates segment signal S2 as shown in FIG. 3. Segment signal S3 is generated by driver 36 when segment 1 is on and segment 2 is off. Segment signal S4 is generated when segment 1 is off and segment 2 is on. Segment signals S1–S4 alternate between Vp and ground. When signal T5 is high, the output of OR gate 35 is "0" and both segments 1 and 2 are coupled to ground.

Signals T1–T5 also control backplane drivers 45 and 46, which drive backplanes A and B, respectively. Backplane driver 45 and 46, which drive backplanes A and B, respectively. Backplane driver 45 generates backplane signal $\phi 1$ and backplane driver 46 generates backplane signal $\phi 2$. Backplane signals $\phi 1$ and $\phi 2$ alternate between Vp, Vp/2 and ground. When signal T5 is high the outputs of OR gates 42 and 44 are high and the outputs of OR gates 41 and 43 are low. Backplanes A and B are coupled to ground as are segments 1 and 2. Thus the voltage across each segment, i.e., the driving voltage, is zero when signal T5 is high.

Figure 4:
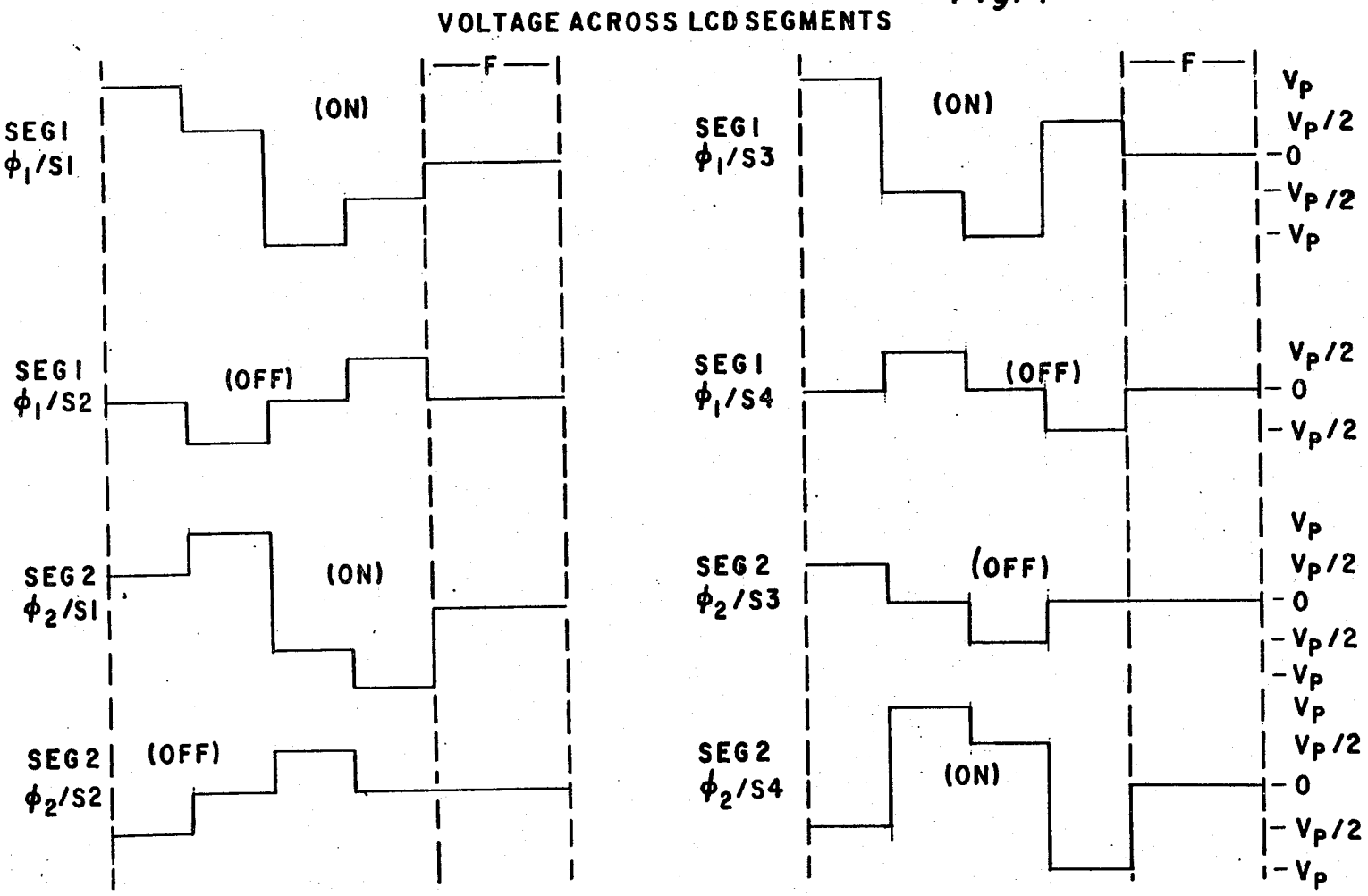
FIG. 4 is an illustration of the various voltage signals across the display segments.

Period F, during which the drive voltage is disabled, occurs during every cycle of the drive voltage. In FIG. 3, period F is chosen to be two units of time or two cycles of the 128 Hz clocking signals. FIG. 4 shows the drive voltage signals across segments 1 and 2 for various on and off states of the segments. Liquid crystal display segments are responsive to the root mean square voltage across the segments. As period F increases, the root mean square voltage driving each segment in both the on and off states decreases. Root mean square voltage, Vrms, can be expressed as follows:

$$V_{rms}\text{ (segment on)} = \sqrt{\frac{V_p^2 + (\frac{1}{2}V_p)^2}{2 + F/2}}$$

Where F=number of cycles of the 128 Hz clock signals during which drive voltage is disabled $$V_{rms}\text{ (segment off)} = \sqrt{\frac{(\frac{1}{2}V_p)^2}{2 + F/2}}$$

For two-way multiplexing Vrms (on)/Vrms (off)=2.24, a constant independent of F.

Period F may be fixed by hardwiring counter 23 or variable by making counter 23 externally programmable. By varying period F, Vrms can be varied to match the particular display material being used without the need for a voltage regulator, thereby reducing power consumption and enhancing voltage control. This system for and method of varying the duty cycle of the drive voltage may be employed in LCD systems such as electronic timepieces and are particularly well-suited to low power CMOS circuitry and for use with a silver oxide battery and doubler circuitry or similar LCD power system. It can be used to control voltages driving three way or higher levels of multiplexed displays as well as non-multiplexed displays.

Since it is obvious that many changes and modifications can be made in the above details without departing from the nature and spirit of the invention, it is understood that the invention is not to be limited to said details except as set forth in the appended claims.

What is claimed is:

1. An electronic data processing system comprising:
   (a) processor means for operating on selected data and information entered into said data processing system;
   (b) liquid crystal display means having a plurality of activatable display segments for displaying the results of selected operations performed by said processor means on a display thereof, said display means comprising:
      (i) drive means for applying a drive voltage to the display segments, said drive means including means for applying a first set of voltage signals to a plurality of backplane electrodes of the display segments and a second set of voltage signals to a plurality of segment electrodes of the display segments in accordance with the information to be displayed; and
      (ii) control means for controlling the application of said first and second sets of voltage signals to said backplane electrodes and segment electrodes, respectively, said control means for controlling said drive means to periodically apply the same voltage to each backplane electrode and its corresponding segment electrode at the same time to periodically disable the drive voltage across each display segment, the drive voltage signal being characterized by a plurality of first signal components during a first plurality of time intervals alternating with a second signal component during a second time interval when the drive voltage is disabled, the second time interval being selected according to the liquid crystal material so that the root mean square drive voltage is adjusted to match the liquid crystal material.

2. The display system according to claim 1 wherein said liquid crystal display is a multiplexed display.

3. The display system according to claim 2 wherein the voltage applied to said backplanes alternates between a predetermined voltage, one-half said predetermined voltage and ground.

4. The display system according to claim 2 wherein the voltage applied to said plurality of segments alternates between said predetermined voltage and ground.

5. The display system according to claim 1 wherein said drive means comprises:
   (i) a plurality of first driver means for applying said first set of voltages to said plurality of backplane electrodes, and
   (ii) a plurality of second driver means for applying said second set of voltages to said plurality of segment electrodes.

* * * * *